United States Patent [19]

Diehl

[11] 4,187,618

[45] Feb. 12, 1980

[54] PAPERMAKERS' FELT

[75] Inventor: Pieter S. Diehl, Pleasant Hill, Ohio

[73] Assignee: The Orr Felt Company, Piqua, Ohio

[21] Appl. No.: 898,819

[22] Filed: Apr. 21, 1978

[51] Int. Cl.[2] ..... B31B 5/06

[52] U.S. Cl. ..... 34/243 F; 139/383 A; 428/235; 428/246; 162/358

[58] Field of Search ..... 34/243 F, 95, 151, 71; 139/383 A; 162/358; 428/234, 235, 246

[56] References Cited

U.S. PATENT DOCUMENTS

| | | | |
|---|---|---|---|
| 3,613,258 | 10/1971 | Jamieson | 34/95 |
| 3,657,068 | 4/1972 | 04001972 | Ivanowicz/162 |
| 4,119,753 | 10/1978 | Smart | 139/383 A X |

FOREIGN PATENT DOCUMENTS

| | | | |
|---|---|---|---|
| 1030994 | 5/1966 | United Kingdom | 34/95 |

OTHER PUBLICATIONS

*Paper Trade Journal*, vol. 161, No. 4, Feb. 15, 1977, p. 59.

*Primary Examiner*—Edward G. Favors
*Attorney, Agent, or Firm*—Biebel, French & Nauman

[57] ABSTRACT

A papermakers' felt for the press or dewatering section of a papermaking machine is formed with an inner woven fabric and with a plurality of longitudinally extending, transversely spaced heavy yarns or strands which are supported on the bottom surface of the fabric by a relatively light cross-machine yarn or binder pick which interconnects the heavy strands with the warp yarns of the fabric. A batting of non-woven material is needled primarily into the upper surface of the inner fabric to form the top of the felt. The underlying strands define therebetween relatively open, longitudinally extending spaces or channels into which the water from the web of paper can flow. Some fibers of the batting intermingle and interlock with the strands to provide additional stability to the felt.

2 Claims, 5 Drawing Figures

PAPERMAKERS' FELT

BACKGROUND OF THE INVENTION

This invention relates to a channel-type papermakers' felt primarily intended for use in the press or dewatering sections of a papermakers' machine. It may be used in the press roll section, which may have plain or grooved rolls, and also is intended for use in connection with suction rolls or suction boxes or the like. The felt can be used as a cylinder top or bottom felt and as a yankee pickup felt.

In U.S. Pat. No. 3,613,258 issued to Jamieson on Oct. 19, 1971, there is disclosed a papermakers' felt whichas attached to the bottom surface thereof, longitudinally extending monofilament plastic strands. The strands are extruded and applied hot to the back surface of a needled felt in the warp direction to form a corresponding series of intermediate channels. The longitudinally extending extruded filaments are inherently formed of a different material than that of the synthetic and animal fibers making up the felt itself, and difficulty has been encountered in effectively bonding the filaments to the base of the felt so that the filaments did not peel off or otherwise become unattached from the felt in use. A further difficulty is in the selection of plastic which has the requisite resiliency to pass repeatedly through the press rolls without extensive flattening or loss of shape and resultant loss of the channels therebetween.

A multiple material or duplex woven base having a batting needled to the upper surface thereof is disclosed in British Patent No. 1,030,994 published May 25, 1966. In the British patent, the base material consists of a two-ply woven yarn in which a lower ply of two-ply base fabric is formed with larger diameter synthetic yarns with a high degree of twist woven in a plain weave of open construction, and interwoven with an upper ply of two-ply base fabric of relatively fine diameter yarns woven in a close weave construction. A non-woven batting is needled into the upper surface thereof. No channel structure is achieved by the British construction. Rather, a regular pattern of drainage holes are formed by the open weave of the lower ply which entrap the water.

SUMMARY OF THE INVENTION

The present invention consists of an improveddewatering felt in which there are two separate systems of warp yarns, each independent of the other, with a single filling system woven with a top layer of warp yarns and a special or second filling system, referred to as a "binder", which interlaces or locks by weaving both systems together, including the second system of warp yarns.

In another aspect of the invention, a felt can be considered as having a woven base construction in which relatively large diameter or heavy longitudinally extending fiber warp yarn strands are secured, by weaving, at or along the bottom of a complete and separate inner woven fabric. The warp yarn strands define therebetween corresponding longitudinally extending open spaces or channels into which the water may flow. The strands themselves form an essentially independent warp yarn structure and are not interwoven with the upper fabric directly, but are retained by the relatively light non-marking cross machine binder structure which interconnects the longitudinally extending strands with the warp yarn structure of the overlying fabric.

A non-woven batting is needled primarily into the upper surface of the woven construction, and the fibers are carried through by the needling operation partially interlocking the heavier warp strands, thus providing an additional structure by which the longitudinally extending strands are supported and interlocked within the base construction. During the needling operation, care is taken so as to drive only a minor portion of the batting fibers completely through the base construction, thereby effectively retaining an open longitudinal channel system between the relatively heavy strands.

The felt of this invention has a high resistance to crushing in view of its high resiliency, and the channel system defined by the warp strands is maintained over a long period of use. The longitudinally extending strands contribute substantially to the tensile strength of the felt and thus provide more resistance to stretching in use. The relatively light cross machine interconnecting binder serves to maintain the relative position of the bottom yarns. The stability of the yarns is further maintained by the fact that a certain extent of the non-woven fibers of the batting are needled and intimately locked with the strands.

A woven and needled felt is thus provided which in effect has two separate systems of warp yarns which are independent of each other. The filling is essentially confined to the yarns of an upper fabric to provide the desired cross machine strength and to provide a supporting surface for the non-woven batting.

It is accordingly an important object of this invention to provide a papermakers' felt for use in the press or dewatering sections of a papermaking machine formed essentially of woven materials, incorporating a channel system at the base or the bottom surface thereof.

Another object of the invention is the provision of a felt, as outlined above, in which relatively heavy strands, extended in the machine direction, are held in transversely spaced relation to define relatively open spaces or channels therebetween, by a relatively light cross machine yarn which interconnects the strands only with the warp of an overlying woven fabric.

Another object of the invention is the provision of a felt, as outlined above, having an upper non-woven batting, an intermediate woven fabric incorporating by weaving a lower fabric consisting essentially of longitudinally extending, transversely spaced, relatively heavy yarns or strands defining a channel system therebetween.

These and other objects and advantages of the invention will be apparent from the following description, the accompanying drawings and the appended claims.

DESCRIPTION OF THE PREFERRED EMBODIMENT

Figure 5:
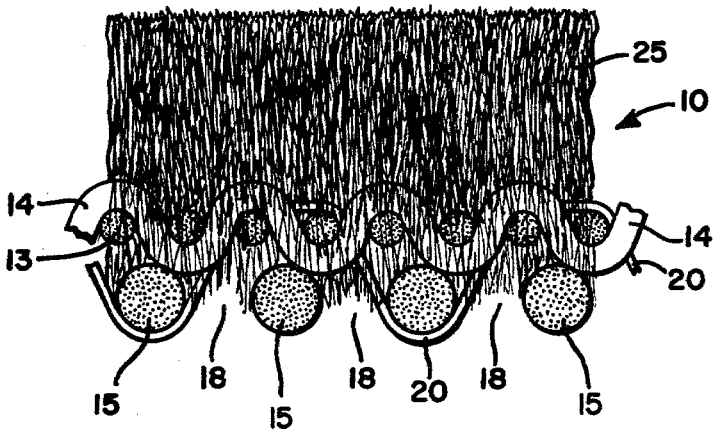
FIG. 5 is a sectional view enlarged to show the completed felt after the batting has been needled thereto.

A completed papermakers' felt made in accordance with this invention is illustrated generally at 10 in FIG. 5. This felt includes a woven inside or inner fabric which is illustrated generally at 12 in FIG. 1. The inner fabric 12 may be a medium class fabric, woven endless, and containing warp yarns 13 and filler yarns 14. A plain weave of the warp and filler yarns is illustrated in the drawings, although the inner fabric can be modified as to weave. Thus, in addition to the plain weave shown, a twill weave, a broken twill, a four, five or six harness satin, a tiger, or a duplex weave may be used. Also, the inner fabric can have yarns which vary with respect to fiber content, grain weight, twist and ply. Also, the number of yarns in the warp and filling direction can vary. The usual considerations of tensile strength, stability, and resistance to widening may be taken into account by those skilled in the art.

Figure 3:
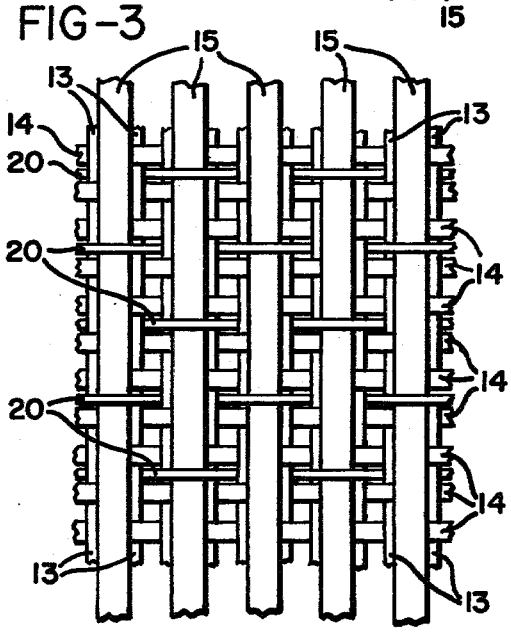
FIG. 3 is a bottom view of the fabric construction of FIG. 2.

The base fabric of the felt also includes a plurality of longitudinally extending, transversely spaced, relatively heavy yarns or strands 15 positioned or located on the bottom surface of the fabric 12, as illustrated in FIG. 3, which forms an outer or back warp. The strands 15 may be a spun fabric yarn, a multifilament yarn, or a monofilament yarn in which any of these may be plied.

The relatively heavy strands 15 are positioned on the fabric 12 in geometric relation to the warp yarns 13, but the number of the strands 15 is less than the number of the warp yarn 13 while the transverse spacing therebetween substantially exceeds the spacing of the overlying warp yarns. In the illustrations shown, there is one of the strands 15 for two of the warp yarns 13.

Figure 4:
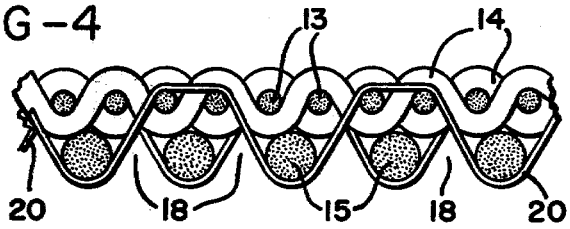
FIG. 4 is a sectional view looking along the line 4—4 of the fabric of FIG. 2, showing the arrangement of the major components of the fabric.

The strands 15 are initially held in place by a relatively light cross machine yarn or binder 20, as shown in FIGS. 3 and 4. Preferably, the cross machine yarns are relatively light in weight as compared to the filler 14, and may in fact consist of a thin synthetic ribbon-like yarn. The cross machine yarns 20 are spaced from each other a longitudinal distance which is preferably substantially greater than the corresponding spacing of the filler yarns 14 and interlace with warp yarns 13 and strands 15. The longitudinal spacing and the weave, as well as the weight, of the binder yarn 20 may vary widely in accordance with the objects of this invention. The binder yarns 20 tend to retain the strands 15 in a desired and fixed longitudinally spaced relation, running in the warp direction, and defining therebetween relative open channel spaces 18, as illustrated in FIGS. 4 and 5.

Figure 1:
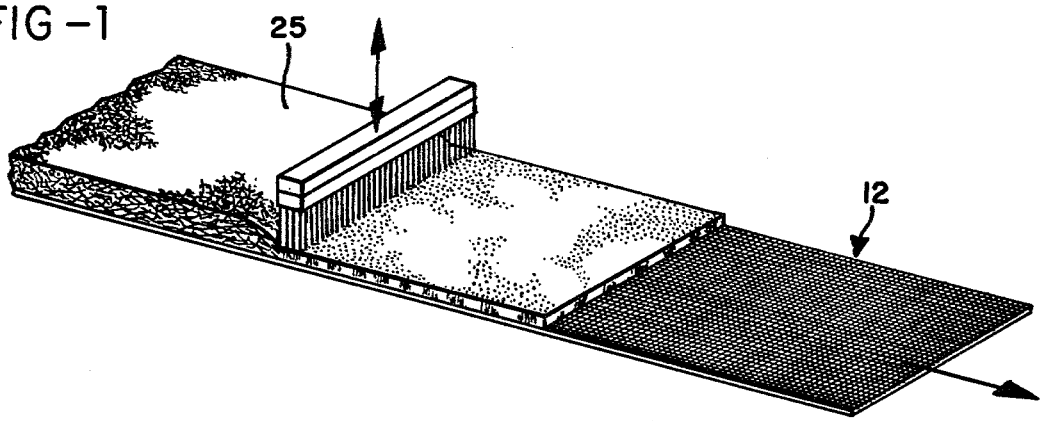
FIG. 1 is a somewhat diagrammatic perspective view showing the needling of a non-woven batting into the upper surface of the woven base material of this invention.
Figure 2:
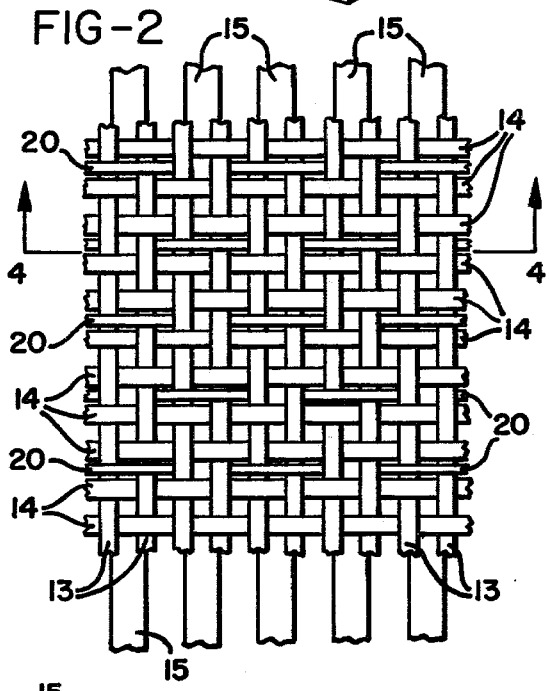
FIG. 2 is an enlarged fragmentary view looking down on the upper surface of the woven base fabric, prior to the application of the non-woven batting.

The composite base fabric illustrated in FIG. 4 is then applied to a needle loom, and a batting 25 of non-woven fibers is applied to the upper surface of the inner fabric 12, as illustrated in FIG. 1. The batting 25 may be wool, synthetic or a blend of the same, and is applied primarily by needling down through the batting and into the upper surface of the inner fabric 12.

In the needling operation, the batting is substantially compacted and the finished thickness of the needled batting 25 is shown somewhat exaggerated in FIG. 5. Individual fibers of the batting interlock with the fibers of the yarns comprising the inner fabric 12. These batting fibers are also carried somewhat through the inner fabric and interlock with the strands 15. This interlocking provides additional stability to the strands 15, but since a major portion of the batting remains on the upper surface of the fabric, only a minor portion thereof extends through the fabric, thereby leaving the relatively open longitudinal spaces or channels 18 which will be only partially filled with batting material, and a relatively lower density as compared to the main body of the batting. If desired, the fabric may be inverted on the needling loom and needled from the back side for the purpose of clearing or reducing the strike through of the batting.

As an example, without intending in any way to limit the scope of this invention as defined by the claims, a felt was manufactured in accordance with the invention employing a medium class fabric 12 containing two-ply synthetic warp yarns 13 and filling yarns 14 in a plain weave with 19½ ends per inch and 14½ picks per inch.

The outer or back warp yarn or strands 15 were a nylon plied multifilament yarn which was heat stabilized and phenolic treated, with a filament count of 140 and a denier size of 840 per strand twisted in a six-ply yarn for a total grain weight of 1130. One-half the number of strands 15 were used compared to the number of filler yarns 13 for an end count of 9¾. The binder or cross machine yarns 20 was a synthetic ribbon with a pick count of 7.25 per inch.

Manufacture of the woven base structure will be understood by those skilled in the art. The base structure may, for example, be woven in an endless manner in which the warp yarns, which run lengthwise from the warp beam, ultimately become the filling yarns 14 and the binder 20, while the filling in the loom ultimately becomes the warp yarns 13 and the outer channel yarn or strands 15.

The batting 25 consisted of 100% nylon which was needled with a total of six rounds, starting with two rounds on face at 9/16 inch penetration and 7/64 advancement, one round on face at 7/16 inch penetration and 7/64 inch advancement, two rounds on back at 5/16 inch penetration and 7/64 advancement, and ending with one round on back at 7/16 inch penetration and 7/64 advancement.

At the completion of the needling, the felt 10 was removed from the loom, was scoured and cleaned and was placed on a dryer to establish tension measurements, to dry, and to heat set. The felt exhibited a high strength build up of 6,200 lbs. tensile per foot and indicated an exceptionally high overall strength and stability. When tension loads were applied there was no evidence of any slackness, wrinkling or non-uniformity.

The individual fibers of the batting for the most part will not penetrate through or into the interior of the strands 15, and the extent to which such fibers may actually penetrate the strands depends largely upon the material forming the strands 15. While there may be some penetration of the fibers into a spun yarn, there will be very little, if any, penetration of the fibers of the batting into a monofilament or a plied monofilament yarn. In either case, there is expected to be a certain amount of strike through of the batting and light film of batting may actually cover the strands, although it is desirable to maintain such strike through at a minimum so that the greater bulk or density of the batting is on the upper surface of the fabric 12, while only a small amount of the batting is carried through and into the region of the longitudinal spaces or channels 18. Whether or not the batting fibers are carried into the strands, they nevertheless serve to provide additional interlocking of the strands to the base fabric and provide additional stability of the strands while leaving the relatively open channels or spaces 18 between the adjacent strands.

The felt is highly resistant to crushing and the channels or grooves defined by the spaces 18 are maintained throughout the normal wear life of the felt on a papermaking machine. The maintenance of such channels reduces and minimizes the risk of rewetting and remarking of the paper supported on the upper surface of the felt.

While the form of apparatus herein described constitutes a preferred embodiment of this invention, it is to be understood that the invention is not limited to this precise form of apparatus and that changes may be made therein without departing from the scope of the invention.

What is claimed is:

1. A needled papermakers' felt for use in the press or dewatering sections of a papermaking machine or the like having improved drainage characteristics, comprising:

a woven inner fabric having warp and filling yarns, a plurality of longitudinally extending, transversely spaced relatively heavy strands positioned on the bottom surface of said fabric, the transverse spacing of said strands being related geometrically to the warp yarns with said spacing being substantially in excess of that of said warp yarns, relatively light cross machine yarns interconnected with said strands, and a batting of non-woven material needled into the upper surface of said fabric with a portion of said batting carried into and interlocking said strands to said fabric to provide additional stability of said strands while leaving relatively open longitudinal spaces between said strands.

2. A needled papermakers' felt for use in the press or dewatering sections of a papermaking machine or the like having improved drainage characteristics, comprising:

a woven inner fabric having warp and filling yarns, a plurality of longitudinally extending, transversely spaced relatively heavy strands positioned on the bottom surface of said fabric, the transverse spacing of said strands being related geometrically to the warp yarns of said fabric, with said spacing being substantially in excess of the corresponding spacing of said warp yarns, relatively light cross machine yarns interconnected with said strands, said cross machine yarns being spaced a longitudinal distance from each other greater than that of said filling yarns, and a batting of non-woven material needled into the upper surface of said fabric with a portion of said batting carried into and interlocking said strands to said fabric to provide additional stability of said strands while leaving relatively open longitudinal spaces between said strands.

* * * * *